US006216959B1

(12) United States Patent
Garrison et al.

(10) Patent No.: US 6,216,959 B1
(45) Date of Patent: Apr. 17, 2001

(54) NOZZLE FOR CENTRIFUGE ROTORS AND METHOD OF REMOVING SAME

(75) Inventors: Larry D. Garrison, Frankfort, IN (US); Kim E. Greenwell, Springfield, OH (US)

(73) Assignee: Fluid-Quip, Inc., Springfield, OH (US)

( * ) Notice: Subject to any disclaimer, the term of this patent is extended or adjusted under 35 U.S.C. 154(b) by 0 days.

(21) Appl. No.: 09/529,092

(22) PCT Filed: Oct. 15, 1998

(86) PCT No.: PCT/US98/21974

§ 371 Date: Apr. 5, 2000

§ 102(e) Date: Apr. 5, 2000

(87) PCT Pub. No.: WO99/20400

PCT Pub. Date: Apr. 29, 1999

Related U.S. Application Data

(60) Provisional application No. 60/062,295, filed on Oct. 17, 1997.

(51) Int. Cl.[7] ..... B05B 17/00

(52) U.S. Cl. ..... 239/1; 239/223; 239/224; 239/600; 81/463; 81/176.1

(58) Field of Search ..... 239/1, 223, 224, 239/289, 600; 81/463, 461, 176.1

(56) References Cited

U.S. PATENT DOCUMENTS

| | | | | |
|---|---|---|---|---|
| 2,695,748 | | 11/1954 | Millard . | |
| 2,855,182 | | 10/1958 | Payne . | |
| 3,795,362 | * | 3/1974 | caldwell et al. | 233/20 R |
| 3,811,517 | | 5/1974 | Bolger . | |
| 4,392,845 | | 7/1983 | Gunnewig . | |
| 4,583,694 | | 4/1986 | Williams et al. . | |
| 4,684,065 | | 8/1987 | Svarrer . | |
| 4,776,412 | | 10/1988 | Thompson . | |
| 4,785,692 | | 11/1988 | Holmes . | |
| 4,794,995 | | 1/1989 | Matson et al. . | |
| 5,033,680 | * | 7/1991 | schultz | 239/223 X |
| 5,183,205 | | 2/1993 | Hoffman . | |

* cited by examiner

*Primary Examiner*—David A. Scherbel
*Assistant Examiner*—Robin O. Evans
(74) *Attorney, Agent, or Firm*—Biebel & French

(57) ABSTRACT

A nozzle removal assembly including an outlet nozzle for centrifuge rotors and cooperating hand tool. The nozzle has an improved structure for facilitating the installation within and removal from a rotor wall. The centrifuge nozzle includes a body portion having inlet and outlet ends wherein the outlet end includes a placement channel. The placement channel defines a radially inwardly facing engagement surface supported externally to the rotor wall for engagement with a hand tool. The hand tool is adapted for engaging the radially inwardly facing engagement surface of the placement channel wherein both rotational and axial forces may be applied to assist in the removal of the nozzle from the rotor wall.

16 Claims, 5 Drawing Sheets

10
100
112
104
108
110
102
20
2
119
118
120
122
116
106
144

NOZZLE FOR CENTRIFUGE ROTORS AND METHOD OF REMOVING SAME

This application is a 371 of PCT/US98/21974 filed Oct. 15, 1998 which is claims benefit of provisional Appln No. 60/062,295 filed Oct. 17, 1997.

BACKGROUND OF THE INVENTION

1. Field of the Invention

The present invention relates to an outlet nozzle for centrifuge rotors and, more particularly, to an outlet nozzle having an improved structure for facilitating installation within and removal from a centrifuge rotor wall.

2. Description of the Prior Art

Centrifugal machines of a nozzle type typically include a rotor defining a separating chamber containing a stack of separating discs for effecting a two-fraction separation of a feed slurry. The feed slurry is separated into a heavy discharge slurry, or underflow fraction, which is delivered outside the rotor by a plurality of nozzles supported within the outer wall of the rotor. A light fraction or separated liquid is removed from the rotor by overflow from the top end of the machine.

To effect proper separation of the feed slurry, it is necessary to rotate the rotor within a conventional centrifugal machine at a high angular speed, typically around 3,100 rotations per minute (RPM). The high rotational speed of the rotor creates sufficient centrifugal force to separate the heavy discharge slurry outwardly to the nozzles supported within the outer wall of the rotor. The centrifugal force also necessitates that the nozzles be adequately secured to the outer wall to ensure that the nozzles remain therein during rotation of the rotor.

One arrangement for securing a centrifuge nozzle to a rotor wall is disclosed in U.S. Pat. No. 2,695,748 to Millard which is incorporated by reference herein. A plurality of such nozzles are mounted at regularly spaced intervals about the periphery of the rotor wall. More particularly, the rotor wall is provided with a plurality of cylindrical bores for receiving the nozzles wherein the axis of each bore is radially disposed with respect to the axis of the rotor. Means are provided for detachably securing each nozzle within the wall wherein the means consists of a lug which is formed integral with the body of the nozzle. The rotor wall is machined to provide an arcuate groove or recess within each cylindrical bore wherein the groove is dimensioned to accommodate the lug. The groove is semi-circular, and its ends open into a cavity formed within the outer surface of the rotor wall adjacent the cylindrical bore.

When the nozzle is positioned within the cylindrical bore such that the lug is disposed within the groove, the nozzle is securely locked to the rotor wall. When the nozzle is turned approximately 180° from this locked position, the lug is brought into registration with the cavity such that the body may be retracted from the rotor wall. A slot is provided on the end of the nozzle for engagement by a suitable turning tool, such as a screwdriver, to facilitate rotation of the nozzle.

During prolonged operation of the centrifuge, the nozzles often become plugged with discharge slurry thereby requiring the cleaning of the discharge orifices in the nozzles. Additionally, it is common for the nozzles to wear or erode over time due to extended contact with the abrasive discharge slurry. In order to facilitate cleaning of the plug discharge orifices, and replacement of worn nozzles, it is well known in the prior art to detachably mount the nozzles in the outer wall of the rotor. Before the Millard nozzle, the prior art means of attachment often required access to the interior of the rotor in order to install or remove the nozzles.

While the above mentioned Millard nozzle has addressed the task of installing new nozzles, there remains a need for improved means of removing nozzles from a rotor wall. While the Millard nozzle facilitates use of a screwdriver to impart torque and rotational movement to the nozzle, no means are provided for applying a force acting radially outwardly from the rotor along the axis of the nozzle to remove the nozzle from its receiving bore. During operation, the nozzles usually become bonded to the rotor wall by solid or liquid materials passing through the centrifuge, such that the nozzles are essentially welded in place. Additionally, sealing means, such as O-rings, provided between the nozzle and the rotor wall resist forces applied in attempts to remove the nozzles from the cylindrical bores within the rotor wall. Attempts to remove the nozzles often leads to the use of screwdrivers or other tools to pry the nozzle out of the rotor wall. The use of these tools against the rotor wall in attempt to gain leverage can result in considerable damage to the rotor wall. In extreme cases, the nozzles are bonded to the rotor wall to such an extent that metal must be welded to the top end of the nozzle so it may be pulled out by applying radially outwardly acting force.

Accordingly, there is a need for a centrifuge nozzle having an improved structure to facilitate installation within and removal from a rotor wall. There is a further need for a hand tool adapted for engaging the centrifuge nozzle to assist a user in installing and removing the nozzle from the rotor wall.

SUMMARY OF THE INVENTION

The present invention provides for an improvement over the prior art centrifuge nozzles by providing a nozzle removal assembly for facilitating application of both rotational and radial forces to a nozzle whereby the nozzle may be easily removed from a rotor wall. In the preferred embodiment, the nozzle of U.S. Pat. No. 2,695,748 is improved by adding a diametrically disposed placement channel within the outlet end thereof.

The nozzle of the present invention includes a body portion having opposing inlet and outlet ends. The body portion is adapted to be received within a cylindrical bore formed within an outer wall of a rotor wherein the longitudinal axis of the body portion is disposed radially with respect to the axis of rotation of the rotor. The outlet end of the body portion is positioned radially outwardly from the inlet end of the body portion.

The body portion defines an inlet bore extending radially outwardly from the inlet end and coaxial with the longitudinal axis of the body portion. An outlet bore intersects the inlet bore wherein the longitudinal axis of the outlet bore is angularly offset from the longitudinal axis of the inlet bore. The outlet bore is provided with an insert which preferably comprises an erosion and corrosion resistant material.

A locking mechanism, preferably a lug, is formed integral with the body portion and is diametrically opposed to the outlet bore. The lug extends outwardly from the body portion away from the longitudinal axis. The lug is adapted to be received within an arcuate groove or recess formed within the cylindrical bore of the outer wall of the rotor to prevent radial movement of the nozzle.

A placement channel formed within the outlet end of the body portion defines a radially inwardly facing engagement surface supported externally to the outer wall of the rotor for engagement with a hand tool. The placement channel includes a diametrically disposed slot and a bore positioned radially inwardly from the slot. The bore extends parallel to the slot wherein the lower portion of the slot intersects the bore.

The hand tool is adapted for engaging the nozzle of the present invention and includes a cylindrical shaft having opposing first and second ends. The first end of the shaft supports a nozzle engaging device comprising a turning member connected to a pulling member. The turning member is adapted to be slidingly received within the slot of the nozzle while the pulling member is adapted to be slidingly received within the placement bore of the nozzle. When positioned within the placement bore, the pulling member engages the radially inwardly facing engagement surface of the placement channel upon application of a radially outwardly acting force to the hand tool, resulting in a radially outwardly acting force being applied to the nozzle. The hand tool further comprises an impact mechanism including a cooperating impact disc and weight member wherein the impact disc is fixed to the shaft and the weight member is slidably received on the shaft and supported for engagement with the impact disc.

To remove the nozzle from the outer wall of the rotor, the pulling member of the hand tool is placed within a cavity formed within the outer surface of the outer rotor wall adjacent the nozzle. The turning and pulling members are next aligned and slid into the slot and placement bore, respectively. A rotational force, or torque, is applied to the tool to rotate the lug until it aligns with the cavity in the cylindrical bore of the rotor wall. A radially outwardly acting force is then applied to the hand tool such that the pulling member transfers the force to the radially inwardly facing surface of the placement bore thereby transmitting the radially outwardly acting force to the nozzle in a direction along its longitudinal axis. The weight member may be moved along the shaft into contact with the impact disc successively to apply successive forces of increased magnitude and short duration radially outwardly against the nozzle. Once the hand tool applies sufficient radially outwardly acting force, the nozzle is released from the rotor wall for easy removal.

Therefore, it is an object of the present invention to provide a centrifuge nozzle which permits the installation and removal of the nozzle from the exterior of the rotor without requiring access to the rotor interior.

It is another object of the invention to provide a centrifuge nozzle which greatly reduces the labor and time required for the installation and removal of the nozzle.

It is a further object of the present invention to provide a centrifuge nozzle which prevents damage to the nozzle and rotor upon removal.

It is still yet another object of the present invention to provide a nozzle removal assembly including a centrifuge nozzle and cooperating hand tool which provide for a radially outwardly acting force along the longitudinal axis of the nozzle for facilitating removal of the nozzle.

It is a further object of the present invention to provide a relatively simple centrifuge nozzle structure which can be readily and inexpensively manufactured.

It is another object of the present invention to provide a hand tool for facilitating manipulation of centrifuge nozzles.

Other objects and advantages of the invention will be apparent from the following description, the accompanying drawings and the appended claims.

DETAILED DESCRIPTION OF THE PREFERRED EMBODIMENT

Figure 1:
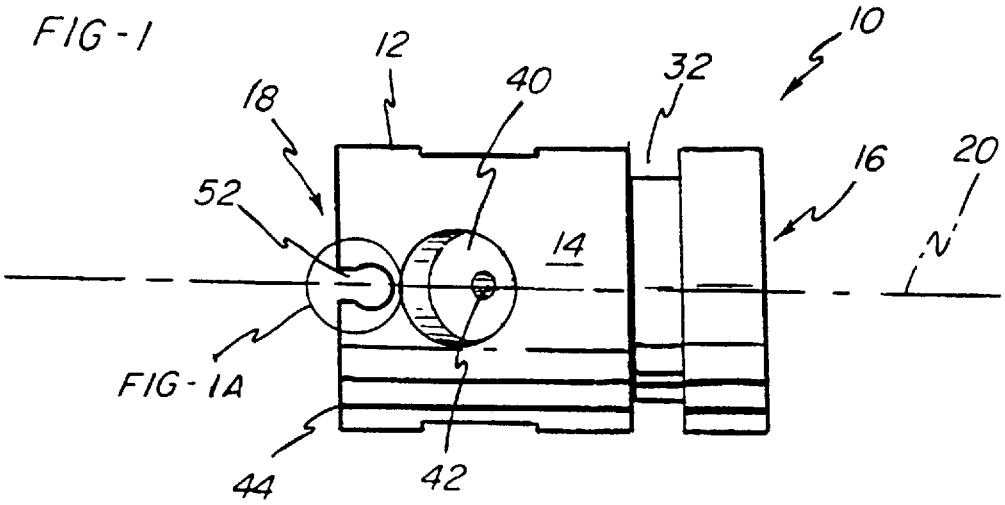
FIG. 1 is a side elevational view of a nozzle of the present invention.
Figure 1A:
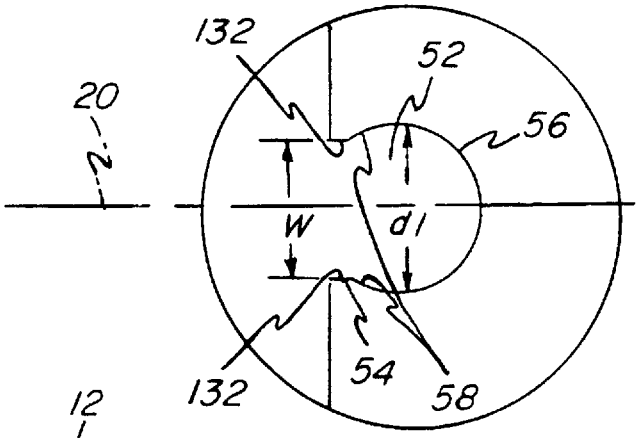
FIG. 1A is an enlarged detail view of the placement channel of the nozzle of FIG. 1.
Figure 2:
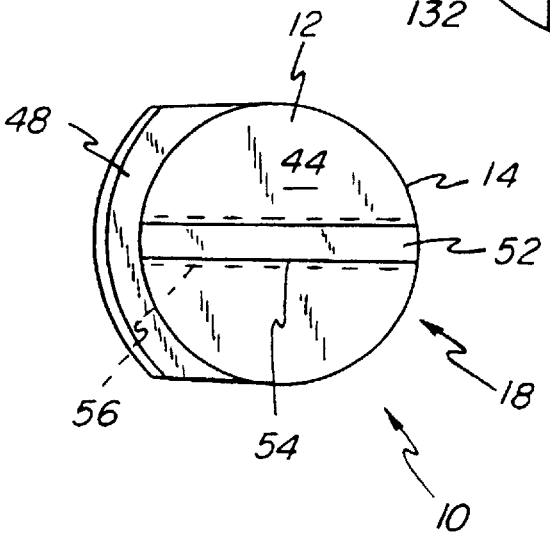
FIG. 2 is an end view of the nozzle of FIG. 1.

Referring initially to FIGS. 1–4, the nozzle 10 of the present invention includes a body portion 12 having an outer cylindrical surface 14. The body portion 12 includes an inlet end 16 and an outlet end 18 wherein the body portion defines a longitudinal axis 20. The nozzle 10 is adapted to be received within a cylindrical bore 22 formed within an outer rotor wall 24. The rotor wall 24 has an outer cylindrical surface 25 and defines a portion of a rotor 26 which, in turn, forms a centrifuge of the type well known in the art.

Figure 3:
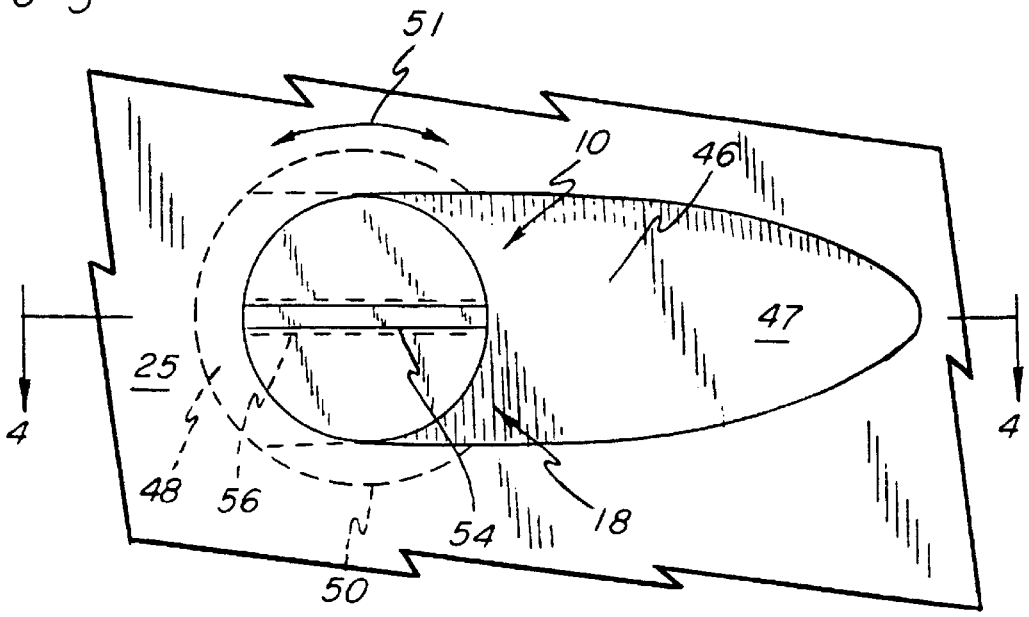
FIG. 3 is an end view of the nozzle of FIG. 1 disposed in an outer wall of a rotor.
Figure 4:
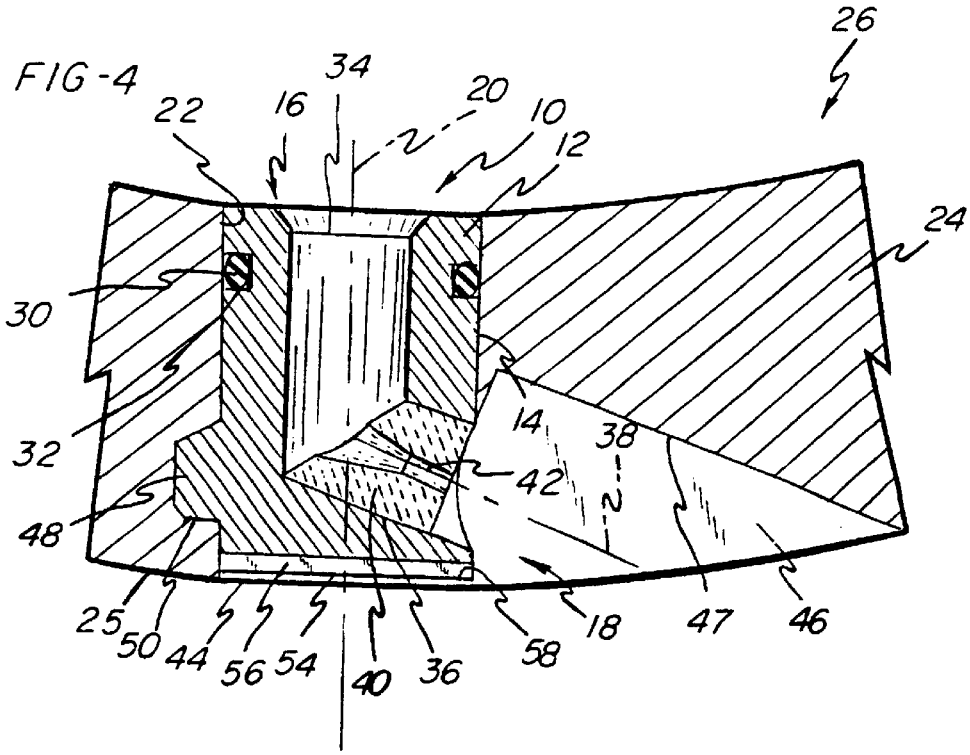
FIG. 4 is a cross-sectional view taken along line 4—4 of FIG. 3.

With further reference to FIGS. 3 and 4, the cylindrical bore 22 within the rotor wall 24 is dimensioned to sealingly engage the body portion 12 wherein the longitudinal axis 20 of the nozzle 10 is radially disposed with respect to the axis of rotation of the rotor 26. In the following description, unless otherwise noted, references to radial direction are with respect to the axis of rotation of the rotor 26, in other words, along the longitudinal axis 20 of the nozzle 10.

A resilient sealing member 30, preferably an o-ring, is received within an annular groove 32 formed circumferentially around the outer surface 14 of the nozzle 10. The resilient member 30 is dimensioned whereby it is compressed in a radial direction with respect to the longitudinal axis 20 when the nozzle 10 is received within the bore 22 whereby sealing contact is maintained between the body 12 and the surface of the bore 22.

The inlet end 16 of the body portion 12 is provided with a cylindrical inlet bore 34 which is coaxially aligned with the longitudinal axis 20. A cylindrical outlet bore 36 is provided in the outlet end 18 of the body portion 12 wherein the outlet bore 36 intersects the inlet bore 34 to provide fluid communication therebetween. A longitudinal axis 38 of the outlet bore is angularly offset from the longitudinal axis 20 of the inlet bore. The outlet bore 36 is preferably fitted with an insert 40 which comprises an erosion and corrosion resistant material, such as tungsten carbide or ceramic. It may be held in place by suitable means such as soldering, brazing or cementing.

In operation, centrifugal force imparted on a feed slurry within the rotor 26 causes a heavy discharge slurry, or underflow fraction, to be delivered to the inlet bore 34. The heavy discharge slurry continues through the inlet bore 34 and through a passageway 42 defined by the insert 40 to a position outside of the rotor 26.

In the preferred embodiment of the nozzle 10, an outlet end face 44 of the body portion 12 is positioned flush with the outer cylindrical surface 25 of the rotor wall 24. A cavity 46, having a surface 47, is provided within the outer surface 14 of the rotor wall 24 to enable free discharge of the heavy discharge slurry from the insert 40 of the nozzle 10. As is well known in the art, the discharge slurry is directed backwardly with respect to the direction of rotation of the rotor 26.

A locking mechanism, preferably a lug 48, extends radially outwardly with respect to the longitudinal axis 20 from the body portion 12 and is integral therewith. The lug 48 is preferably diametrically opposed to the outlet bore 36 (FIG. 4). The rotor wall 24 is machined to provide an arcuate groove or recessed portion 50 for accommodating the lug 48. The groove 50 defines a semicircle of approximately 270° wherein its ends are open to the cavity 46. As shown in FIG. 3, when the lug 48 is positioned within the groove 29, the nozzle 10 is securely locked within the rotor wall 26 wherein radial movement along the longitudinal axis 20 is prevented. However, when the body 12 is rotated approximately 180°, as indicated by arrow 51, from the position shown in FIG. 3, the lug 48 no longer locks the nozzle 10 in place.

Returning to FIGS. 1 and 2, a diametrically disposed placement channel 52 is provided within the end face 44 of the body portion 12. The placement channel 52 is preferably defined by a slot 54 and a bore 56 positioned radially inwardly along the longitudinal axis 20 of the nozzle 10 relative to the slot 54, such that the bore 56 is positioned closer than the slot 54 to the inlet end 16. The slot 54 opens toward the outlet 18 and has a width w. In the preferred embodiment, the slot 54 perpendicularly intersects the longitudinal axis 20, i.e., extends transversely to the body portion 12.

The placement bore 56 extends parallel to the slot 54 wherein the slot 54 and placement bore 56 intersect to thereby define the placement channel 52. The placement bore 56 is preferably cylindrical in nature and has a diameter of d1 which is greater than width w of the slot 54. It will be appreciated that while the placement bore 56 preferably has a substantially circular cross-section, other cross-sections may be substituted therefor. More particularly, the placement bore 56 may have a rectangular or triangular cross-section.

The placement bore 56 includes reentrant edges defining a pair of substantially radially inwardly facing engagement surfaces 58 supported for engaging a hand tool 100, as will be described in detail hereinafter. The engagement surfaces 58 face inwardly toward the inlet end 16 of the body portion 12. Turning to FIGS. 3 and 4, the radially inwardly facing engagement surfaces 58 have at least one end located radially outside of an adjacent portion of the outer surface 47 of the cavity 46. The placement channel 52 has one end open to, or in communication with, the cavity 46 wherein clearance is provided adjacent the engagement surfaces 58 for access by the hand tool 100. More particularly, both the slot 54 and placement bore 56 each have at least one end opening to the outer surface 14 of the body portion 12.

Figure 5:
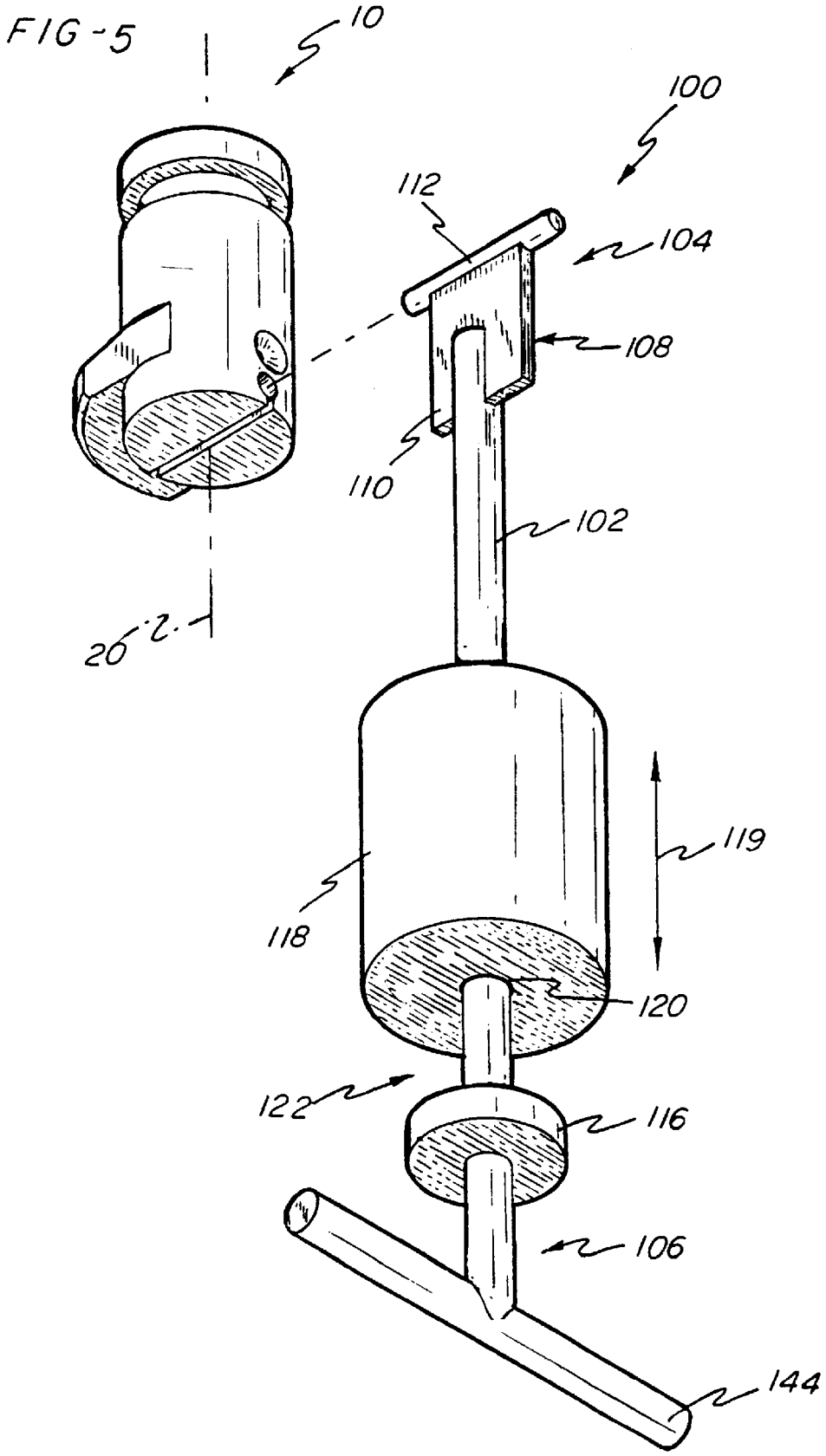
FIG. 5 is a perspective view of a hand tool of the present invention aligned with the nozzle of FIG. 1.
Figure 6:
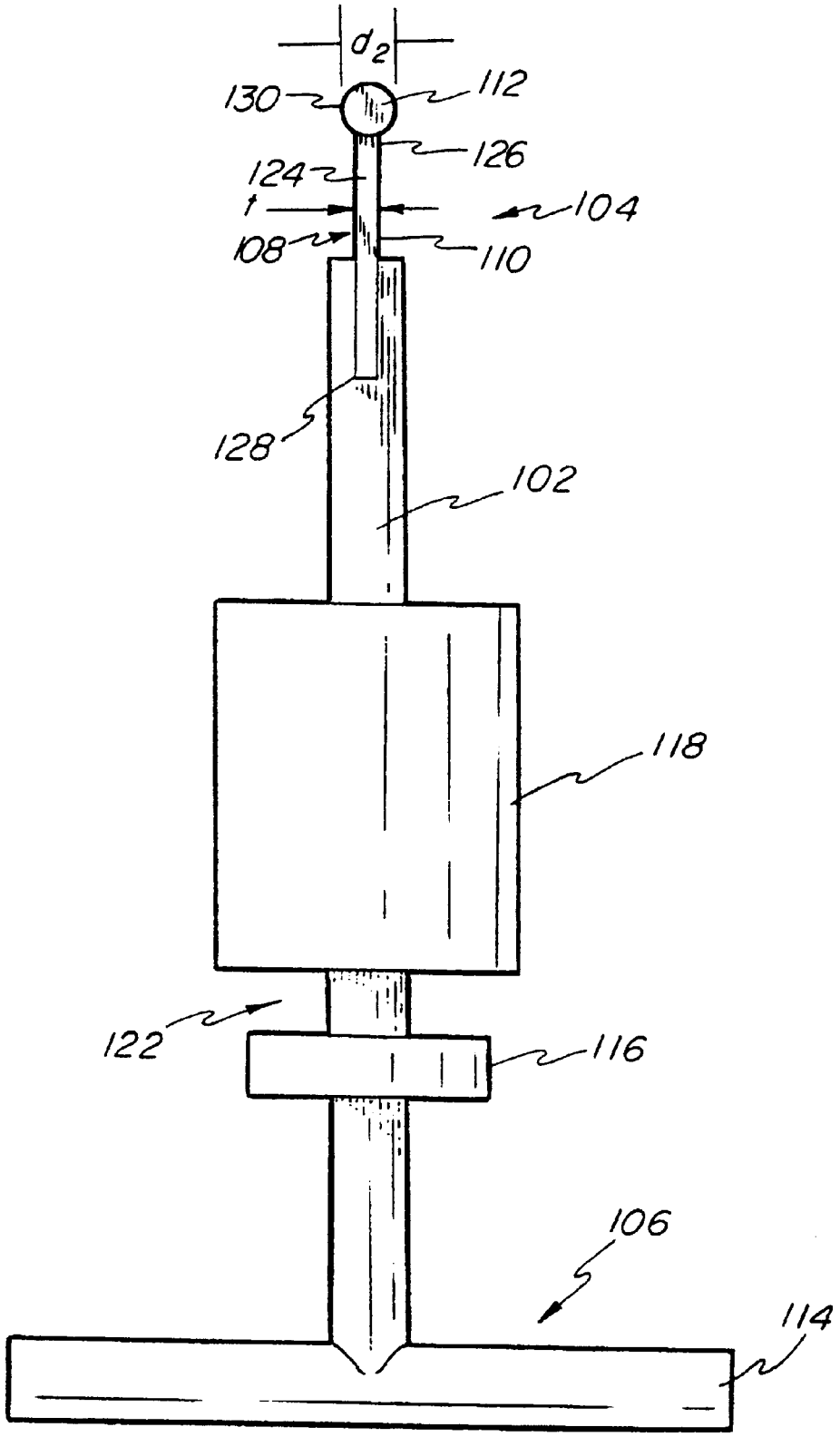
FIG. 6 is a side elevational view of the hand tool of FIG. 5.

FIG. 5 illustrates a hand tool 100 which together with the nozzle 10 of the present invention defines a nozzle removal assembly. The hand tool 100 is adapted to provide both torque, or rotational force, and radial force acting along the longitudinal axis 20 of the nozzle 10 for assisting in the assembly and disassembly of the body portion 12 with the cylindrical bore 22. The hand tool 100 includes a cylindrical shaft 102 having first and second ends 104 and 106. The first end 104 of the shaft supports a nozzle engaging device 108 including a turning member 110 and a pulling member 112. The second end 106 of the shaft is connected to a handle 114 adapted to be gripped by the user.

An impact disc 116 is rigidly fixed to the shaft 102. A weight member 118 is slidingly received on the shaft 102 for movement there along in the direction of arrow 119 in FIG. 5. More particularly, the shaft 102 is received within a cylindrical bore 120 formed within the weight member 118. The impact disc 116 and weight member 118 together define an impact mechanism 122 adapted to provide additional outward pulling force to assist the user in dislodging the nozzle 10 from the rotor wall 24.

Turning now to FIGS. 1A and 6–7A, the turning member 110 of the nozzle engaging device 108 is adapted to be received within the slot 54 of the nozzle 10. The turning member 110 comprises a substantially planar plate 124 having a thickness t which is less than the width w of the slot 54 such that the plate 124 may be slidingly received within the slot 54. A first end 126 of the plate 124 supports the pulling member 112, while a second end 128 of the plate is fixed to the shaft 102.

In the preferred embodiment, the pulling member 112 comprises a cylindrical rod 130 adapted to be slidably received within the placement bore 56. The diameter d2 of the cylindrical rod 130 is less than the diameter d1 of the placement bore 56. However, the diameter d2 of the rod 130 is greater than the width w of the slot 54 such that the rod 130 cannot pass between opposite side edges 132 of the slot 54 and instead engages the engagement surfaces 58.

Operation will now be described with respect to removing a nozzle 10 locked by the lug 48 within the rotor wall 24. It should be appreciated that a similar operation is utilized to install the nozzle 10 within the bore 22 of the rotor wall 24.

First, the user positions the tool 100 within the cavity 46 of the rotor wall 24 adjacent the outlet end 18 of the nozzle 10. Next, the tool 100 is aligned with the placement bore 56 and slot 54 of the nozzle 10. More particularly, the plate 124 and rod 130 are axially aligned to be received within the slot 54 and placement bore 56. The plate 124 and rod 130 are then slidably received within the slot 54 and bore 56, as illustrated in FIG. 7.

Figure 7:
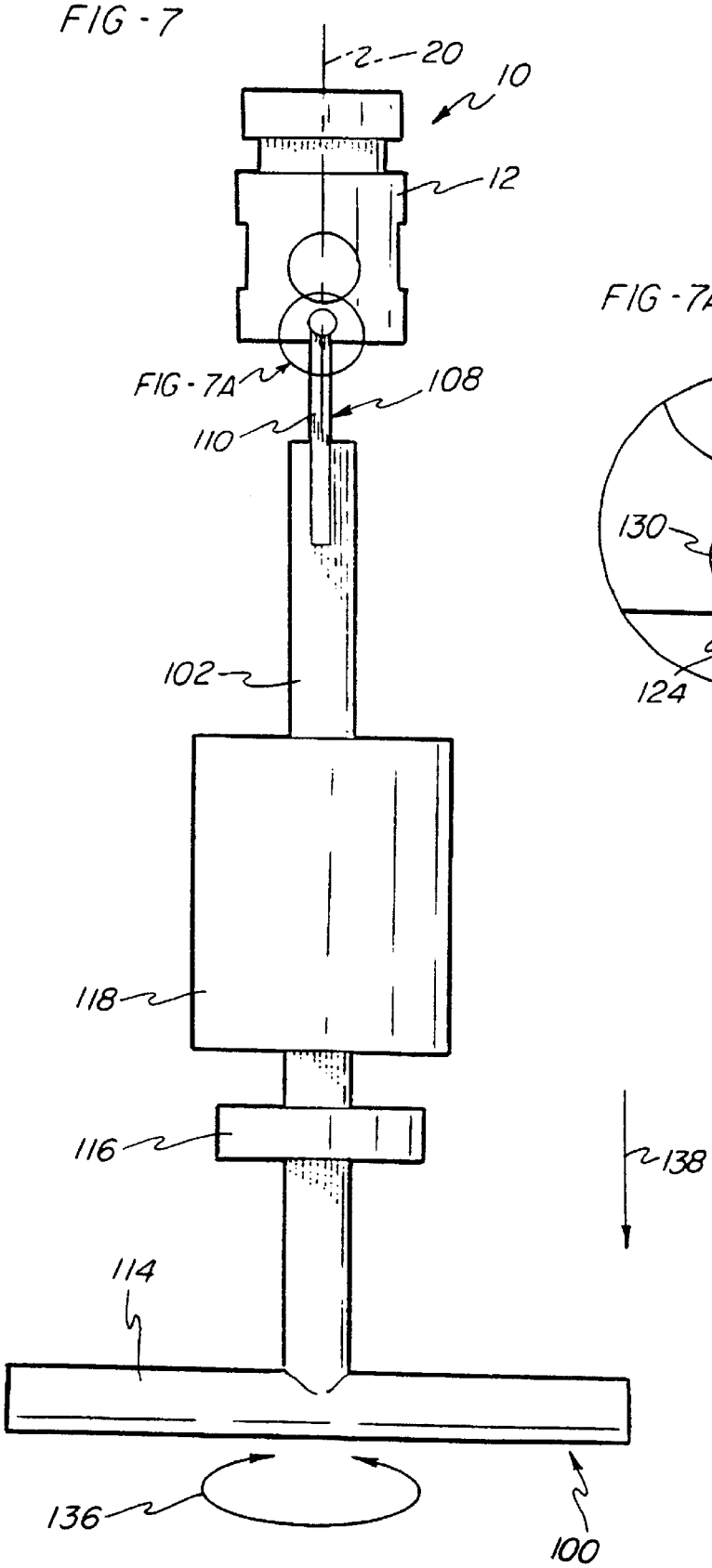
FIG. 7 is a side elevational view of the hand tool of FIG. 5 engaging the nozzle of FIG. 1.
Figure 7A:
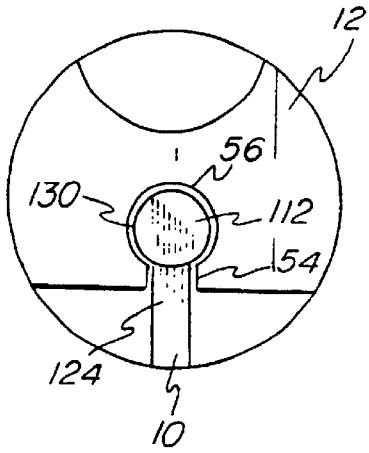
FIG. 7A is an enlarged detail view of FIG. 7 illustrating the hand tool engaging the placement channel.

The user next rotates the tool 100 by gripping and turning the handle 114 to apply a torque to the nozzle 10 as illustrated by arrow 136 in FIG. 7. The plate 124 engages one of the slot edges 132 thereby transferring the applied torque and rotating the body 12 in a the direction of arrow 51 around axis 20 as shown in FIG. 3.

When the lug 48 has been rotated approximately 180°, the operator applies a radially outwardly acting force to the tool 100 by pulling the handle 114 as illustrated by arrow 138 in FIG. 7. This force is transferred along longitudinal axis 20 thereby causing the rod 130 to engage the radially inwardly facing engagement surfaces 58 of the placement bore 56. The axial force is transferred to the body portion 12 of the nozzle 10 thereby breaking any bonds formed between the body portion 12 and the rotor wall 24 by dried slurry or other materials within the rotor 26. The nozzle 10 may then be removed from the rotor wall 24 for repair or replacement. It should also be noted that the rod 130 by engaging the surfaces 58 provides for easy handling of the nozzle 10 once it has been removed from the rotor wall 24.

Should the nozzle 10 be particularly stubborn and resist being removed because of strong bonds between the rotor wall 24 and the body portion 12, the impact mechanism 122 may be utilized. The operator moves the weight member 118 along the shaft 102 radially inwardly towards the nozzle 10 and then quickly brings the weight member 118 back to the impact disc 116 for contact therewith. By impacting the impact disc 116 with the weight member 118 in rapid succession, successive spikes of increased force in the radially outwardly direction along the longitudinal axis 20 are applied to the body portion 12 thereby breaking the bonds securing the body portion 12 within the rotor wall 24.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. An outlet nozzle for use with a centrifuge rotor, said outlet nozzle comprising:

a body portion having opposing inlet and outlet ends;

an inlet bore extending within said body portion from said inlet end;

an outlet bore intersecting said inlet bore at an angular offset;

a resilient sealing member received by an outer surface of said body portion between said inlet and outlet ends;

a locking mechanism integral with said body portion for securing said body portion to a centrifuge rotor wall;

a placement channel formed within said outlet end of said body portion; and an engagement surface defined by said placement channel and facing inwardly toward said inlet end.

2. The outlet nozzle of claim 1 wherein said placement channel includes at least one end opening to an outer surface of said body portion.

3. The outlet nozzle of claim 1 wherein said placement channel includes a diametrically disposed slot extending transversely to said body portion and opening toward said outlet end.

4. The outlet nozzle of claim 3 wherein said placement channel further includes a bore extending parallel to and intersecting said slot.

5. The outlet nozzle of claim 4 wherein said bore is positioned inwardly toward said inlet end of said body portion relative to said slot.

6. A nozzle removal assembly comprising:

an outlet nozzle including a body portion having opposing inlet and outlet ends, a resilient sealing member received by an outer surface of said body portion between said inlet and outlet ends, a locking mechanism integral with said body portion for securing said body portion to a centrifuge rotor wall, a placement channel formed within said outlet end of said body portion, and an engagement surface defined by said placement channel and facing inwardly toward said inlet end;

a hand tool for engaging said outlet nozzle, said hand tool including a shaft having opposing first and second ends, a nozzle engaging device supported on said first end, said nozzle engaging device slidably received within said placement channel and including a turning member and a pulling member connected to said turning member; and wherein said pulling member is engagable with said inwardly facing engagement surface.

7. The nozzle removal assembly of claim 6 wherein:

said placement channel includes a diametrically disposed slot having opposed side edges; and said turning member is selectively engagable with said side edges for imparting torque to said body portion of said nozzle.

8. The nozzle removal assembly of claim 7 wherein said placement channel further includes a bore extending parallel to and intersecting said slot.

9. The nozzle removal assembly of claim 8 wherein said pulling member comprises a cylindrical rod slidably received within said placement bore and engagable with said engagement surface.

10. The nozzle removal assembly of claim 6 wherein said placement channel includes at least one end opening to an outer surface of said body portion for slidably receiving said nozzle engaging device.

11. The nozzle removal assembly of claim 6 wherein said hand tool further comprises:

an impact mechanism including an impact disc fixed to said shaft; and a weight member slidably received on said shaft and supported for selective engagement with said impact disc.

12. The nozzle removal assembly of claim 6 wherein said hand tool further comprises a handle positioned at said second end of said shaft.

13. The nozzle removal assembly of claim 6 wherein a first end of said turning member supports said pulling member and a second end of said turning member is fixed to said shaft.

14. A method of removing a nozzle from an outer wall of a centrifuge rotor, said method comprising the steps of:

providing a nozzle including a body portion having inlet and outlet ends, and a locking mechanism formed integral with said body portion for securing said nozzle to a centrifuge rotor wall;

providing a placement channel within said outlet end of said body portion, said placement channel having an engagement surface facing inwardly toward said inlet end;

providing a hand tool including a shaft having opposing first and second ends and a nozzle engaging device supported on said first end;

aligning said nozzle engaging device of said hand tool with an open end of said placement channel of said nozzle;

sliding said nozzle engaging device into said placement channel;

applying a torque to said shaft of said hand tool thereby rotating said nozzle engaging device into contact with said placement channel and transmitting said torque to said body portion of said nozzle;

rotating said nozzle thereby releasing said locking mechanism from said centrifuge rotor wall;

applying a force to said hand tool substantially parallel to a longitudinal axis of said nozzle;

causing said nozzle engaging device to forcibly engage said engagement surface of said placement channel; and removing said nozzle from said centrifuge rotor wall.

15. The method of claim 14 wherein said step of applying a force to said hand tool comprises the steps of:

providing a handle on said second end of said shaft of said hand tool; and pulling said handle outwardly away from said centrifuge rotor wall.

16. The method of claim 14 wherein said step of applying force to said hand tool comprises the steps of:

providing said hand tool with an impact mechanism including an impact disc fixed to said shaft and a weight member slidably received on said shaft; and selectively and successively impacting said impact disc with said weight member thereby providing successive spikes of increased force to said body portion of said nozzle.

* * * * *